US005370166A

United States Patent [19]

Mason

[11] Patent Number: 5,370,166

[45] Date of Patent: Dec. 6, 1994

[54] LOG ORGANIZER

[76] Inventor: Howard C. Mason, 31988 Country View La., Wilsonville, Oreg. 97070

[21] Appl. No.: 151,129

[22] Filed: Nov. 12, 1993

[51] Int. Cl.[5] ..... B27B 31/00; B66F 11/00

[52] U.S. Cl. ..... 144/242 R; 144/208 R; 144/242 E; 144/245 A; 414/746.7; 209/653

[58] Field of Search ..... 209/602, 653; 414/745.7, 746.2, 746.7; 144/242 R, 242 E, 245 R, 245 A

[56] References Cited

U.S. PATENT DOCUMENTS 3,638,792 2/1972 Bilocq ..... 209/653
4,628,781 12/1986 Rowley ..... 414/746.7

*Primary Examiner*—W. Donald Bray
*Attorney, Agent, or Firm*—Kolisch, Hartwell, Dickinson, McCormack & Heuser

[57] ABSTRACT

A log organizer that receives logs fed end-to-end thereinto. The organizer includes a tubular device disposed with its axis paralleling an elongate log support extending under the device. The device has an elongate opening extending along its bottom side. A log lodged within the device is directed to one or the other side of the support with pivotal movement of the device.

13 Claims, 3 Drawing Sheets

LOG ORGANIZER

BACKGROUND AND SUMMARY OF THE INVENTION

This invention relates to what is referred to herein as a log organizer which, as the term is used herein, refers to apparatus usable in selecting logs from a series of logs and diverting such logs for further processing.

The apparatus of the invention is described herein in the context of equipment for receiving logs moving downstream from a debarker, where the logs typically leave the debarker with the logs traveling lengthwise and following one another as a series of logs. The apparatus contemplated functions to receive such logs fed in serial fashion into the apparatus, and may then be used to organize the logs with the logs traveling along different flow paths. For instance, each flow path might include a cut-off saw for cutting the logs traveling therealong into specified or random lengths. With two flow paths or processing lines provided for the handling of logs, the rate at which logs are processed is substantially increased over the rate possible where only one processing line is provided. A debarker mechanism handles log at a relatively fast rate, and usually at a considerably faster rate than a cut-off saw mechanism where a log periodically has its travel stopped while cutting is performed. With the equipment contemplated, the faster operating machinery, i.e., the debarker, may be operated substantially continuously, with logs downstream moving smoothly through operations that are performed more slowly.

While the invention has been described in connection with a debarker, it is not intended in all instances to be limited to such use, as the organizer of the invention may beneficially be incorporated with other pieces of equipment where similar problems are involved.

A general object of the invention is the provision of apparatus of the type described which is rapid and reliable in operation.

More particularly, an object is to provide an improved organizer apparatus having a construction which particularly suits itself for the handling of articles such as logs, which in a typical mill will have various sizes, lengths and tapers, and will be nonlinear in that certain logs will be misshapen and include crooks or bends rendering them more difficult to handle by automated means.

A further and more specific object is to provide apparatus for receiving and restraining logs as they flow as a series one after another from equipment such as a debarker, which features an elongate hollow body or device with a passage extending therealong, the hollow body having an opening extending along its bottom side which faces a log support. The body is mounted for pivotal movement about an axis extending the length of the log support, with the lower portion of the body, on pivotal movement, rocking either to one or the other side of the log support. This movement is utilized to divert a log laterally from the log support, in a rapid and reliable manner. With the body returned to a position centered over the log support, a position is reestablished for the body for the reception of another log inserted thereinto.

The construction contemplated is relatively maintenance free. The tubular body or device contemplated reliably guides and restrains logs fed thereinto. Log debris easily falls from the tubular body to maintain the body clean and free of debris.

These and various other objects and advantages are attained by the invention, which is described hereinbelow in conjunction with the accompanying drawings, wherein:

DETAILED DESCRIPTION OF THE PREFERRED EMBODIMENT

Figure 1:
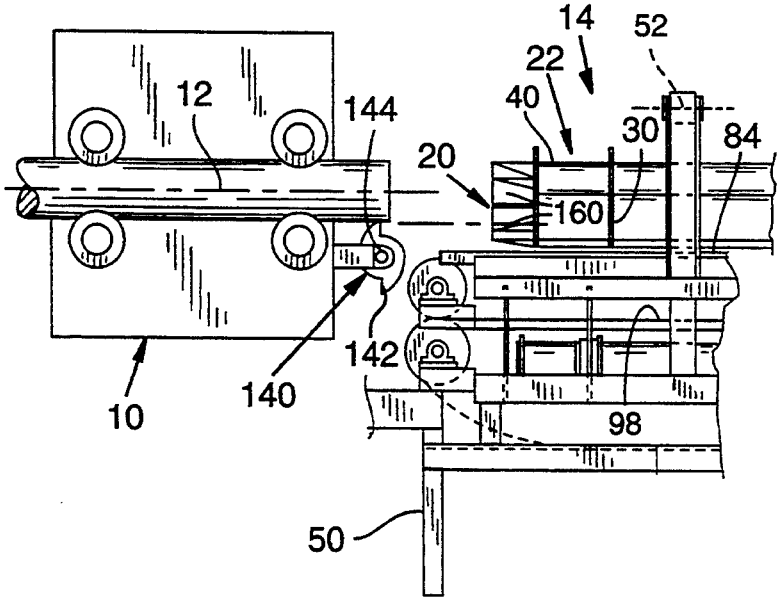
FIG. 1 is a simplified side view illustrating portions of the organizer of the invention, with such forming part of an outfeed conveyor system for a debarker.

Referring now to the drawings, illustrated generally at 10 is the outline of a log debarker. In a typical mill, logs are supplied the debarker one after another. The logs travel through the debarker with the logs traveling lengthwise and following one another as a series of logs.

In the debarker, typically a suitable conveying roll mechanism is provided for advancing the logs one after another through the machine. In a ring debarker, which is exemplary of a commercial debarker presently in use, the individual logs pass through the center of a ring with structure on the ring serving to engage the bark of the log and free it from the surface of the log. Debarkers currently available operate at relatively high speed, with some debarkers not uncommonly having a rated feed speed of from 300 to 400 feet per minute.

Logs, on leaving debarker 10, move with the axis of a log traveling generally along the axis line shown at 12. The logs travel into what is herein broadly referred to as an organizer 14, and which functions to receive the logs and then arrange them into two flow paths, where the logs may be further processed as by cutting them to selected lengths.

Considering in more detail the construction of organizer 14, such includes an elongate hollow body or tubular device, also referred to as a receiving-and-restraining structure, designated at 17, and disposed beneath this device, an elongate log support, designated at 18. The log support extends out horizontally from the outfeed end of the debarker and tubular device 17 extends generally parallel to the log support but is disposed slightly above it.

Figure 4:
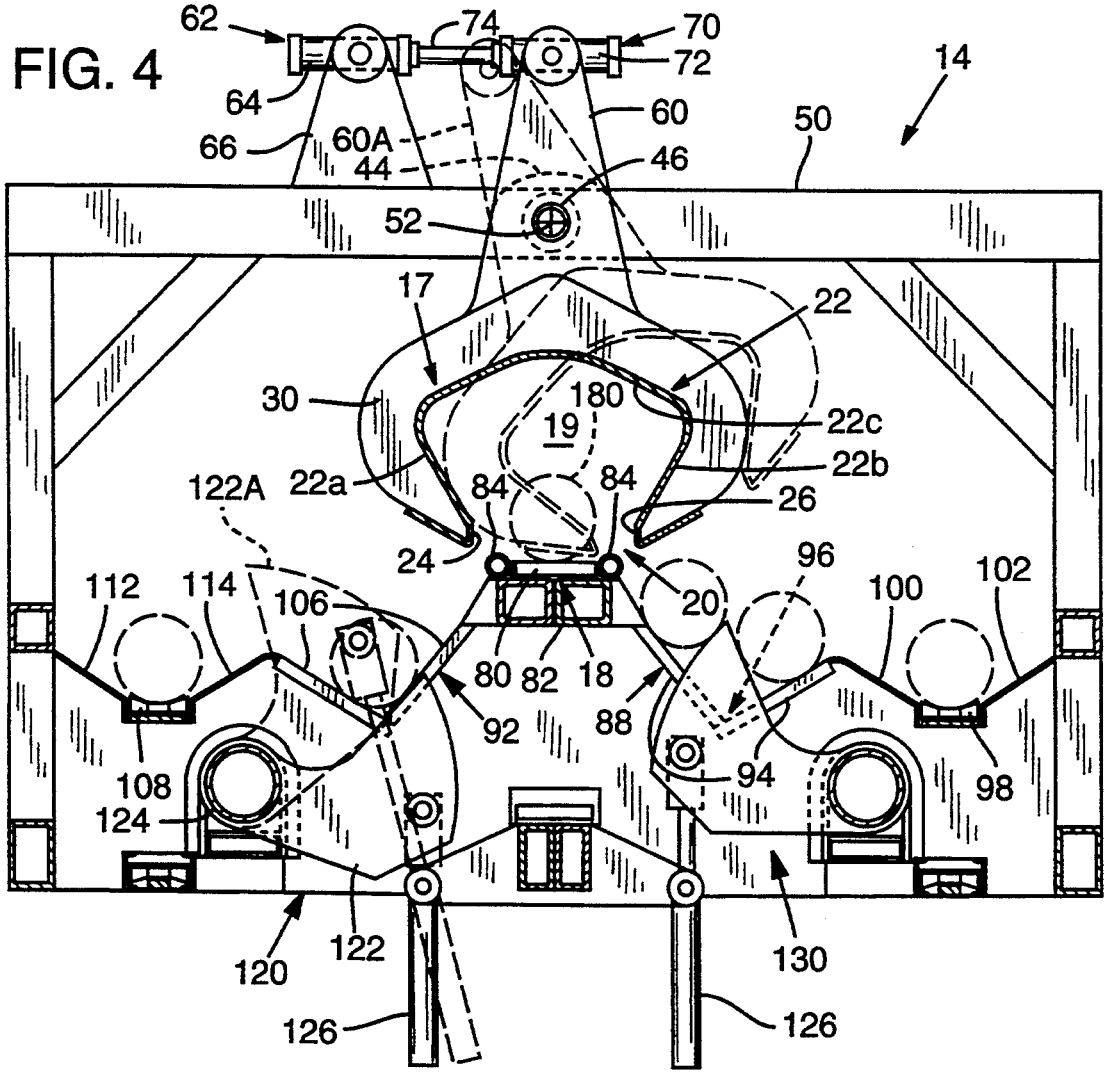
FIG. 4 is a cross-sectional view, on a somewhat enlarged scale, taken generally along the line 4—4 in FIG. 3.
Figure 2:
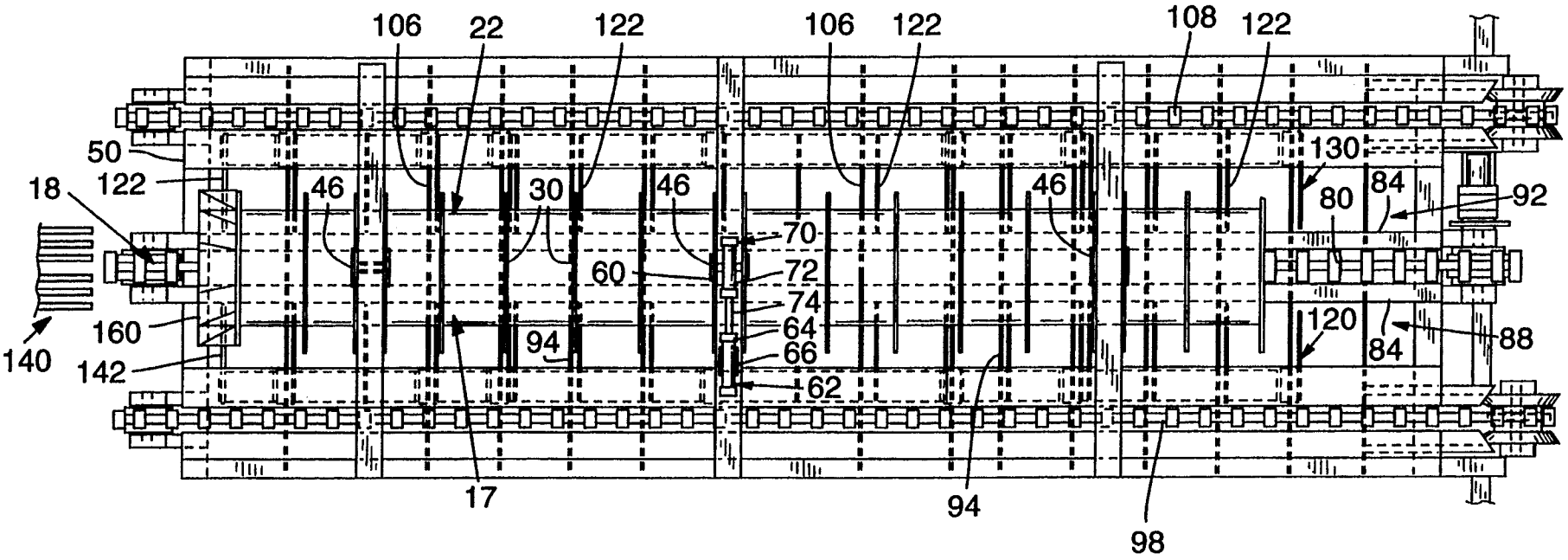
FIG. 2 is a top view of the organizer.
Figure 3:
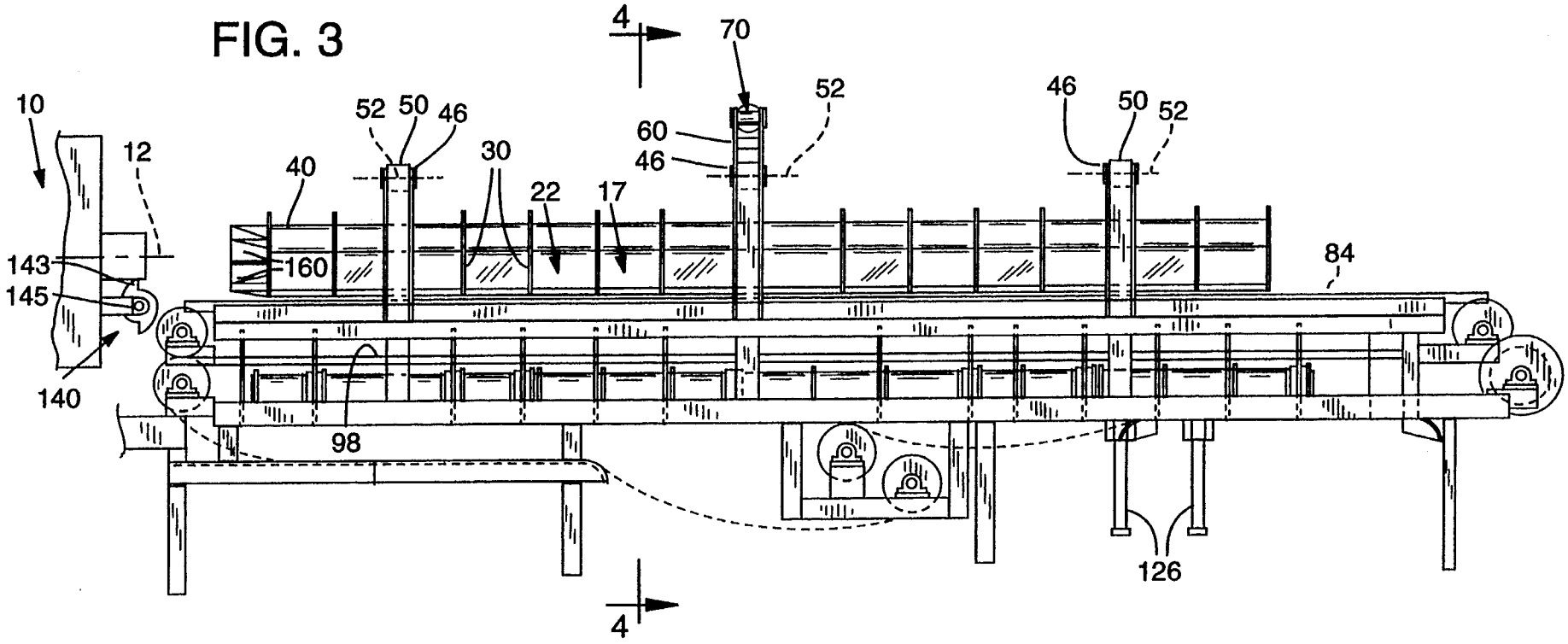
FIG. 3 is a side view of the organizer.

Tubular device 17 has a hollow interior 19. In the particular embodiment illustrated, the device has a noncircular cross-section, as best illustrated in FIG. 4. Extending along the bottom side of the hollow body or device is an elongate opening 20, which faces downwardly and directly overlies log support 18.

Hollow body or device 17 is formed of an elongate continuous wall 22. As best shown in FIG. 4, along one side of the device the wall extends as an elongate downwardly depending skirt portion **22*a*, and on the opposite side of the device extends as an elongate downwardly depending skirt portion 22*b*. Forming a continuation of these two skirt portions, and extending in an approximately arcuate expanse, is a ceiling portion 22*c***. These skirt and ceiling portions collectively bound the hollow interior or tunnel which extends along the length of the device.

At opening 20, skirt portion 22*a* along its lower margin is substantially fiat and upright, thus to provide an elongate bump shoulder 24. Skirt portion 22*b* is similarly configured to provide a bump shoulder 26. The bump shoulders are utilized in deflecting a log lying within the interior of the device, either to one or to the other side of log support 18, which lies below opening 20.

Spaced at intervals along the tubular device or hollow body, and strengthening wall 22, are C-shaped braces 30. The legs of the braces straddle skirt portions 22*b*, 22*c*. The braces throughout their length are suitably secured to wall 22.

Lugs 44 distributed along the length of the hollow body or tubular device are suitably joined to certain ones of the C-shaped braces 22. These lugs have upper portions, journaled as at 46, on frame 50 of the apparatus. These journals provide a pivot axis for the tubular body, indicated at 52, which extends horizontally and along the length of the hollow body or tubular device, and which is spaced above the log support.

Pivotal movement of the tubular device and its strengthening brace structure is produced under power. In tile structure shown, and referring to FIG. 4, an arm 60 extends upwardly from one of tile C-shaped braces to a location spaced above journals 46 and pivot axis 52. A ram 62 with a cylinder 64 has its cylinder mounted with a trunnion-type mounting on post 66 extending up from frame 50. Another ram 70 has its cylinder 72 mounted with a trunnion-type mounting on the upper end of arm 60. Extending between the two rams, and interconnecting their respective pistons, is a common rod 74.

With the construction described, and with actuation of rams 62, 70 to swing arm 60 to the position shown in dashed outline at 60A in FIG. 4, the hollow body or tubular device is swung from left to right, with bump shoulder 24 moving laterally and in a wide arc over the top of the log support 18. At the same time, bump shoulder 26 swings outwardly and upwardly, to open up and provide a free space to the right of log support 18 as such is illustrated in FIG. 4.

Further explaining, with the tubular device in the position shown in solid outline in FIG. 4, portion 22*a* and portion 22*b* extend downwardly and occupy blocking positions blocking any log on the log support from lateral movement off the log support. With the tubular body swung from left to right in FIG. 1 as just described, portion 22*b* swings to a nonblocking position. Portion 22*a* which is opposite swings so that its bump shoulder 24 sweeps across the log support with lateral dislodging of any log resting thereon.

Log support 18 may take any of a number of different forms. For instance, a log on moving out from the log debarking is subject to a forward thrust resulting from the conveying system in the debarking as long as a portion of the log still resides in the debarker. With this organization, the log support may comprise an elongate pan extending the length of the apparatus and which provides a supporting surface which the log rests upon when its movement comes to a stop. Alternatively, some sort of powered conveyor may be provided, such as a powered conveyor chain. In the particular construction illustrated, the log support takes the form of a powered conveyor with an upper run of the conveyor, illustrated at 80, extending along the length of the log support. The conveyor run is itself supported by framing 82 and opposed guide rails 84.

To each side of log support 18 is an elongate holding pocket structure which is adapted to receive and hold a log moved to one side of the log support by actuation of tubular device 17. In FIG. 4, one of such holding pocket structures is indicated at 88. A similar one on the opposite side of the log support 18 is indicated at 92. The two structures are similar in construction.

Considering holding pocket structure 88, guide elements 94 provide an elongate trough 96 extending along one side of log support 18. Laterally outwardly of trough 96 is a powered conveyor chain, including an upper run 98. Run 98 of the conveyor chain extends parallel to the log support. Guide surfaces 100, 102 on either side of conveyor chain run 98 guide a log into a seated position on the conveyor chain run.

Pocket structure 92 on the opposite side of the apparatus is similar to pocket 10 structure 88. The structure includes guide elements 106 defining a trough for seating a log moved thereinto. Outwardly of pocket structure 92 is a log conveyor formed by the upper run 108 of a power-driven conveyor chain. Guide surfaces 112, 114 are located to either side of conveyor chain run 108.

A kicker is provided for dislodging a log held within a pocket structure and depositing such on a log conveyor. Considering pocket structure 92, such a kicker structure is shown at 120 and comprises multiple kicker plates 122 disposed in a row and mounted on a shaft 124. The plates have a lowered position as demonstrated by the plate 122 shown in solid outline in FIG. 4, and a raised position as demonstrated by the position for a plate indicated at 122A in FIG. 4. The plates are swung between raised and lowered positions as by ram 126.

A similar kicker structure 130 is provided for dislodging logs from pocket structure 88 and depositing such on conveyor chain run 98.

A log advancer is shown at 140 positioned intermediate the outfeed end of the debarker and the infeed end of receiving-and-restraining structure 16. The advancer includes kicker plates 143 secured to a shaft 145. The advancer is operated intermittently. When the butt end of a log falls downwardly on the advancer on being ejected from the debarker, the advancer may have its shaft 145 rotated 180 degrees whereby any log resting thereon is thrown forwardly to be lodged fully within restraining structure 17.

Inclined funnel plates 160 suitably joined as by welding to a brace 30 provided at the feed end of the hollow body or tubular device 17 serve to steer the end of the log into the hollow body with the log first emerging from the debarker. The plates collectively form a funnel mouth at the infeed end with the funnel plates providing deflector surfaces that slope in a converging direction progressing through tile outfeed end of the tubular device. It should be remembered that logs are not always straight, but will contain crooks and bends causing an offset in the end of tile log as it emerges from tile debarker. The funnel mouth described is important in providing for the proper feeding of tile log into the apparatus described.

Describing the operation of the equipment. Logs are fed one after another into the debarker. On moving through tile debarker, bark is removed in a continuous fashion as the log advances.

On leaving the debarker, tile lead end of the log enters the receiving-and-restraining structure 17. Because the log is encompassed on all sides by this restraining structure and the log support along the bottom, the log is properly confined on all sides even though substantially deformed as with a bend or crook.

After moving free of the debarker, the log comes to rest within the restraining structure supported on log support 18. A log so positioned is illustrated by the circular outline indicated at 180 in FIG. 4.

A log on the log support is then diverted either laterally to one or to the opposite side of the log support. This throws the log into pocket structure 88 or pocket structure 92. The log may be rapidly cleared from the restraining structure, which enables the restraining structure quickly to return to the standby position for the structure, which is the position shown in solid outline in FIG. 4.

A log in a pocket structure is shifted laterally, on demand, onto a log conveyor through actuation of a kicker structure. When a log becomes deposited on a log conveyor, as exemplified by conveyor run 108, such may be advanced in intermittent fashion past a cutoff saw mechanism where the log is cut to selected length.

It will be noted that the organizer described divides the flow of logs into the organizer into logs travelling along multiple flow paths. As a consequence, the effective rate of movement of the log along one of these flow paths may be at a slower rate than the movement of the log through the debarker.

The apparatus can be used to sweep a log to one or the other side of support 18, while at the same time receiving and positioning a new log fed from the debarker.

The apparatus described is relatively trouble free and sure in operation. Debris tends to fall clear of the apparatus during its normal operation.

While an embodiment of the invention has been described, obviously modifications and variations are possible without departing from the invention.

It is claimed and desired to secure by Letters Patent:

1. A log organizer for serially fed logs comprising:

an elongate log support with an infeed end onto which logs travel while traveling lengthwise, elongate receiving-and-restraining structure positioned over said support having an elongate passage defined therein with said passage located over said support and extending in the direction of said support, said restraining structure having one portion on one side of the support disposed in a blocking position blocking a log from lateral movement in a direction extending beyond said one side and further having another portion on the opposite side of the support in a blocking position blocking a log from lateral movement in a direction extending beyond said opposite side of the support, the restraining structure further including a ceiling portion blocking a log from upward displacement, and a mounting for the restraining structure accommodating selective movement of either said one or said other portion to a nonblocking position wherein the side formerly blocked by the portion of the restraining structure is opened up.

2. The log organizer of claim 1, wherein said one portion and said other portion of the receiving-and-restraining structure are joined, and said mounting for the receiving-and-restraining structure produces on movement of one of said portions to a nonblocking position, movement of tile other of the portions in a direction across the log support.

3. The log organizer of claim 1, which further includes, on each side of the log support, a holding pocket structure positioned below tile support for receiving and holding a log moved laterally from the support by movement beyond said one side of the support with the log dropping into said pocket structure, a log conveyor substantially paralleling the holding pocket structure, and transfer means for transferring a log from the holding pocket structure to the log conveyer.

4. The log organizer of claim 1, which further comprises a log advancer adapted to engage the trailing end of a log positioned adjacent the infeed end of the log support and operable to advance a log by engaging said trailing end and moving it onto the log support.

5. The log organizer of claim 1, wherein said mounting includes a pivot for the receiving-and-restraining structure pivotally supporting the structure for pivotal movement about a pivot axis extending above and in the direction of said log support, the receiving-and-restraining structure depending from said pivot.

6. The log organizer of claim 1, wherein said receiving-and-restraining structure includes an infeed and an outfeed end, and a funnel mouth at said infeed end with deflector surfaces that slope in a converging direction progressing toward said outfeed end for guiding a log entering the receiving-and-restraining structure.

7. The log organizer of claim 2, wherein said one and said other portions of said receiving-and-restraining structure each have a lower margin and an elongate upright bump shoulder extending along the lower margin which extends longitudinally of the log support, the bump shoulder moving laterally while in an upright position across the log support.

8. A log organizer for processing logs fed lengthwise one after another thereto comprising:

an elongate log support, a receiving-and-restraining structure positioned over said support, said receiving-and-restraining structure including an elongate tubular device positioned over said support having a longitudinal axis substantially paralleling the log support, the device having opposed depending skirt portions forming opposite sides of the device, the device further including a ceiling portion joining with and forming a continuation of the skirt portions, said skirt and ceiling portions defining an elongate internal passage extending over said log support, said skirt portions having bottom margins disposed adjacent opposite sides of said log support defining an elongate opening facing said support, and pivot structure mounting said device for swinging about an axis substantially paralleling said log support.

9. The log organizer of claim 8, wherein said receiving-and-restraining structure has an infeed and an outfeed end, and which further includes a funnel mouth at said infeed end of the restraining structure with deflector surfaces that slope in a converging direction progressing toward said outfeed end of the receiving-and-restraining structure.

10. The log organizer of claim 8, wherein each of said depending skirt portions has an elongate upright bump shoulder extending along a lower margin of the skirt portion which substantially parallels the log support and which moves laterally and while upright across the log support with pivotal movement of the receiving-and-restraining structure.

11. A log organizer for processing logs with such logs fed lengthwise thereinto one after another comprising:

an elongate log support, an elongate tubular device positioned over said support having a longitudinal axis substantially paralleling said support, said tubular device having opposed depending skirt portions forming opposite sides and a ceiling portion joining with and forming a continuation of the skirt portions, said skirt and ceiling portions defining an elongate internal passage extending over said log support, said skirt portions having bottom margins disposed adjacent opposite sides of said support defining an elongate opening facing said support, the skirt and ceiling portions collectively having a C-shaped cross section, C-shaped braces distributed along the length of the tubular device and over the outside of the tubular device and secured thereto, and pivot structure pivotally mounting said tubular device for pivotal movement about an axis paralleling said longitudinal axis, said pivot structure pivotally connecting with said braces.

12. The log organizer of claim 11, which further includes power-operated means connecting with at least one of said braces actuatable to produce powered pivotal movement of the tubular device.

13. The log organizer of claim 12, wherein the tubular device has an infeed end, and which further includes a mouth for said infeed end, said mouth including deflecting surfaces that incline inwardly toward each other progressing from the infeed to the outfeed end of said tubular device.

* * * * *